United States Patent [19]

Mayr et al.

[11] 3,970,063

[45] July 20, 1976

[54] FUEL INJECTION SYSTEM

[75] Inventors: Theodor Mayr; Siegfried Buchta; Rudolf Kleeberger; Otto Bauer, all of Munich, Germany

[73] Assignee: Robert Bosch G.m.b.H., Stuttgart, Germany

[22] Filed: Oct. 24, 1974

[21] Appl. No.: 517,640

[52] U.S. Cl. ..... 123/139 AW; 123/139 R

[51] Int. Cl.[2] ..... F02B 3/02

[58] Field of Search ..... 123/139 AW, 32 JV

[56] References Cited

UNITED STATES PATENTS

| | | | |
|---|---|---|---|
| 2,436,079 | 2/1948 | Shipp | 123/32 V |
| 3,013,545 | 12/1961 | Noftz et al. | 123/139 AW |
| 3,029,800 | 4/1962 | Armstrong | 123/139 AW |
| 3,044,457 | 7/1962 | Ball | 123/139 AW |
| 3,431,900 | 3/1969 | Jackson | 123/139 AW |
| 3,724,435 | 4/1973 | Bier | 123/139 E |
| 3,872,850 | 3/1975 | Littlehales | 123/139 AW |

FOREIGN PATENTS OR APPLICATIONS

| | | | |
|---|---|---|---|
| 1,577,740 | 6/1969 | France | 123/139 AW |
| 1,066,721 | 4/1967 | United Kingdom | 123/139 AW |
| 1,074,807 | 7/1967 | United Kingdom | 123/139 AW |

*Primary Examiner*—Wendell E. Burns
*Assistant Examiner*—James W. Cranson
*Attorney, Agent, or Firm*—Edwin E. Greigg

[57] ABSTRACT

A fuel injection system for internal combustion engines employing continuous fuel injection into an induction tube. The system includes a regulator which maintains constant fuel pressure upstream of a fuel metering and distribution valve assembly which has individual metering apertures for each injection valve of the engine. A control slide determines the effective cross-section of these metering apertures. The pressure gradient across the metering apertures is held constant by fuel injection valves constructed as flat-seat valves whose movable valve closing member is attached to and guided by a diaphragm. Fuel delivered by the metering and distribution valve tends to open the flat seat valve, permitting fuel to flow through the valve orifice. This opening force is opposed by a single helical control spring, or by a single helical control spring augmented by ambient air pressure. The valve closing member may be provided with a central bore. In that case, an air stream is caused to flow through the central bore under the influence of the pressure differential between the ambient air pressure and the induction tube pressure. This air stream aids in the atomization of the injected fuel.

5 Claims, 1 Drawing Figure

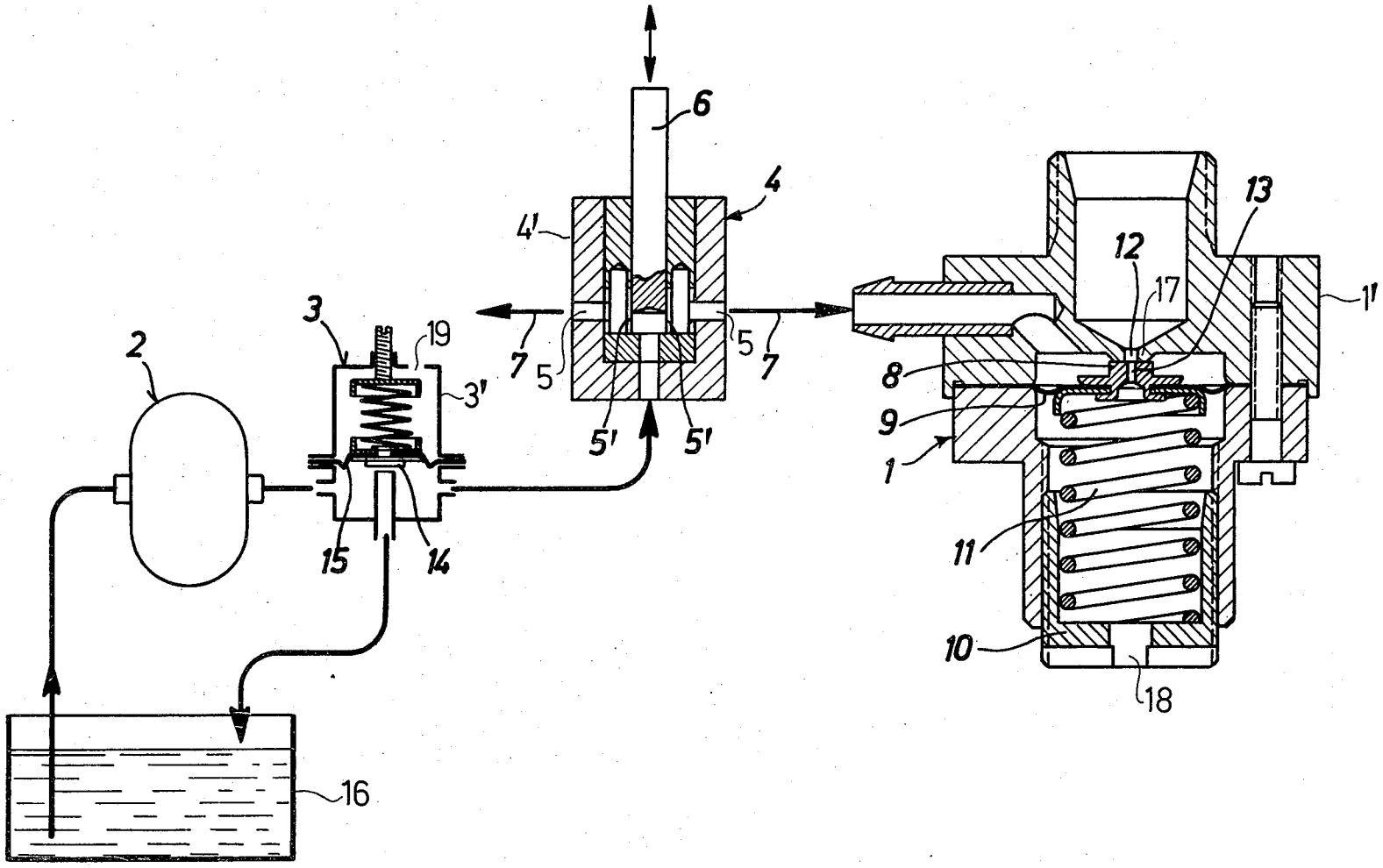
11
13
17
12
18
11
10
8
9
1
4
7
5
6
5'
5'
4'
5
7
3'
19
14
3
15
16
2

FUEL INJECTION SYSTEM

BACKGROUND OF THE INVENTION

The invention relates to a system for the continuous injection of fuel into the induction tube of a mixture-compressing, internal combustion engine provided with a fuel metering and distribution assembly. In operation, a fuel pump delivers fuel continuously via a pressure regulator to the fuel metering and distribution assembly which distributes metered-out fuel through variable throttle apertures to injection valves embodied as control valves. The movable valve member of these fuel injection valves which obturates the valve orifice is attached to a diaphragm. One side of the diaphragm is subjected in an opening direction to the fuel pressure downstream of the fuel metering and distribution assembly. The other side is subjected to a counterforce exerted by a spring in opposition to the fuel pressure. The spring force acts to close the fuel injection valve.

In a known fuel injection system of this type, such as is disclosed for example in German published application 1,212,789, the diaphragm which controls the movable valve member of the injection valve is loaded in the opening direction by the fuel pressure prevailing downstream of the fuel metering and distribution assembly and it is loaded in the closing direction firstly by the force of a valve closing spring embodied as a helical compression spring and also by a secondary fuel pressure whose level has a fixed relation to the fuel pressure level prevailing upstream of the fuel metering and distribution assembly. The relationship between these two pressure levels is such that the secondary pressure, together with the force of the valve closing spring, determines the fuel pressure experienced by the other side of the diaphragm, i.e., the pressure prevailing downstream of the fuel metering and distribution assembly. The magnitude of the pressure experienced by the other side of the diaphragm is equal to the fuel pressure prevailing upstream of the fuel metering and distribution assembly diminished by the pressure drop across the associated throttle aperture within the metering assembly. This pressure drop is to be kept as constant as possible.

Thus, the injection valves are expected to perform the function of control valves with the object of maintaining the pressure drop across the associated throttle aperture within the fuel metering and distribution assembly within very narrow and negligible tolerance limits determined by the rigidity of the valve closing spring. This is done to insure a linear relationship between the injected fuel quantity per injection valve and the flow cross-section of the throttle aperture associated with that particular injection valve, independently of the pressure drop across the injection valve orifice, which varies with the air pressure in the induction tube of the engine, and also independently of any fuel pressure fluctuations upstream of the fuel metering and distribution assembly.

It is a disadvantage of this known fuel injection system that it requires considerable expenditures for structural elements and for supplementary fuel lines which are required for delivering fuel to the control diaphragm attached to the movable valve closing member of the injection valve so as to apply a control pressure which stands in a fixed relation with respect to the fuel pressure prevailing upstream of the fuel metering and distribution assembly.

OBJECTS AND SUMMARY OF THE INVENTION

It is, therefore, an object of the invention to provide a fuel, injection system of the type described above which is improved over the state of the art and which lacks the functional disadvantages associated with the known types of fuel injection systems.

It is another object of the invention to provide a fuel injection system of the type described above which is improved over the state of the art and which achieves significant economy from its design due to its structural simplicity and the fact that the system does not need as many pressure lines.

It is still another object of the invention to provide a fuel injection system of the type described above which is improved over the state of the art and whicn insures an improved fuel atomization during idling operation of the engine and in the lower load domain of the engine.

These and other objects are attained, according to the invention, by providing an improved fuel injection system wherein the diaphragm within the fuel injection valves is actuated in the closing direction of the valve by a counter-force provided exclusively by a spring, augmented, if necessary, only by atmospheric pressure; and wherein the rigidity of the spring is such that its influence on the pressure drop across a particular throttle aperture of a fuel channel of a fuel metering and distribution valve assembly connected to the fuel injection valve is slight and can therefore be neglected.

Thus, in injection valves which require only one exact opening setting, there is no need to deliver fuel to the diaphragm which controls the valve closing member of the injection valve at a pressure having a particular, fixed relation with respect to the fuel pressure prevailing upstream of the fuel metering and distribution assembly, a need which would require considerable structural expenditure and additional pressure lines.

The invention is based on the discovery that the pressure gradient across the throttle apertures within the fuel metering and distribution assembly may be held constant within a negligible tolerance range and at an exact setting of the valve opening point by injection valves which are constructed according to the invention. This constancy may be made independent of the pressure gradient across the valve orifice of the injection valve and also independent of the opening characteristics of the injection valves. This may be done by providing a very precisely functioning pressure regulator upstream of the metering and distribution valve assembly. Many types of such a pressure regulator are available at the present state of the art and they do not require a large additional expense.

From British Pat. No. 1,066,721, it is known in apparatus for continuous fuel injection, to employ injection valves having a diaphragm controlled valve member. The diaphragm controlling the valve closing member is subjected in the opening direction of the injection valve by the pressure prevailing upstream of the valve seat and in the closing direction of the injection valve by an adjustable helical compression spring. However, this injection apparatus is different from the injection system according to the invention because it uses a separate fuel metering valve for metering out the fuel to the internal combustion engine, this valve having only a single throttle aperture with variable flow cross-section. A separate control valve is disposed upstream of the fuel metering valve for holding the pressure drop across the throttle aperture constant. The flow cross-section of this valve is changeable by a resilient member separating two chambers. The first chamber is subjected to the fuel pressure prevailing downstream of the metering valve which tends to open the control valve and the second chamber is under the fuel pressure prevailing upstream of the metering valve and this tends to close the control valve. These pressures are applied to the resilient member of the control valve. Downstream of the fuel metering valve, the system includes a separate distribution valve which distributes fuel metered out to the internal combustion engine by the fuel metering valve. The distribution takes place through individual throttle cross-sections to the various injection valves. The movable valve member which controls the various throttle cross-sections is loaded in the opening sense of the distribution valve by the fuel pressure prevailing downstream of the metering valve and it is loaded in the closing sense of the distribution valve by a helical compression spring.

It is desired to achieve a uniform distribution of the metered fuel to the individual injection valves and, since the fuel distribution occurs downstream of the fuel metering valve, it must be independent of the metered fuel quantity and also independent of the pressure drop across the injection valve orifice which is determined by the variable induction tube pressure. To meet these requirements, each fuel injection valve must act as a control valve and must maintain a constant pressure gradient across its associated throttle cross-section in the distribution valve, but it should not attempt to keep constant the pressure gradient across the throttle aperture in the fuel metering valve because this is done by the control valve disposed upstream of the fuel metering valve.

In the above described, known fuel injection system, when an injection valve jams in the closed position, the fuel which would normally flow to this injection valve is disadvantgeously distributed to the other injection valves. This causes a decay of engine power in addition to the power loss due to the failure of the injection valve and a considerable increase of the toxic components in the exhaust gas.

In a particular, advantageous embodiment of the present invention, the valve closing member of the fuel injection valves may be provided with a central bore, substantially coaxial with the valve orifice bore. On the other side of the diaphragm loaded by the helical compression spring the central bore communicates with the ambient air.

The result of this construction is that, due to the pressure gradient between the atmospheric air pressure and the induction tube suction pressure, an atomizing air stream is produced in a simple manner which flows very near to the location where fuel exits from the injection valve and which, especially for small injection quantities, produces excellent atomization of fuel and thus provides a very good preparation of the fuel mixture.

It is known to improve the fuel atomization in fuel injection valves with the aid of an atomizing air stream, see for example British Pat. No. 1,074,807. In that system, the atomizing air stream does not pass the fuel exit orifice as closely as in the present invention and, hence, the fuel is not so well dispersed as is the case with the injection valve according to this further embodiment of the invention.

In another advantageous further embodiment of the invention, the injection valves are flat-seat valves. This embodiment insures that even when the stroke of the movable valve member is very short and, thus, the effective force of the spring is changed only very little, nevertheless a large valve aperture flow cross-section is opened. At the same time, the flat-seat valve represents an important simplification of the manufacturing process for these injection valves.

Injection valves embodied as flat-seat valves are known, see for example, French Pat. No. 1,577,740, but not when used with a fuel injection system of the above-described type.

BRIEF DESCRIPTION OF THE DRAWING

The single FIGURE of the drawing is a partially sectional and partially schematic representation of an exemplary embodiment of the injection valve and of associated components of the invention.

DESCRIPTION OF THE PREFERRED EMBODIMENT

The fuel injection system includes several fuel injection valves 1, each including a housing 1' within which a diaphragm controlled valve closing member 8 is mounted. The injection valves are supplied with fuel by a continuously operating fuel pump 2 via a constant pressure regulator 3, and a fuel metering and distribution assembly 4. The fuel pump 2 draws fuel from a fuel tank 16.

The assembly 4 includes a housing 4' within which there is defined a separate fuel channel 5 for each injection valve whose aperture 5' or flow cross-section is changeable for metering the fuel quantity. The assembly 4 also includes an injection quantity setting member which serves for the common adjustment of the aperture 5' of all the fuel channels 5 and which is embodied as a control slide 6 which is displaced arbitrarily by suitable known external means (not shown) in the directions of the double arrow in the FIGURE. Fuel is delivered from the fuel metering and distribution assembly 4 to the injection valves 1 through individual fuel lines 7.

Each injection valve 1 also includes a valve seat 17, a diaphragm 9 which controls the motion of the valve closing member 8, a spring 11 and a set screw 10. In one preferred embodiment, the side of the diaphragm 9 remote from the valve seat is exposed to the force of the spring 11. In another preferred embodiment the remote side of the diaphragm 9 is exposed to atmospheric air pressure by the provision of an opening 18 in the set screw 10 and also to the force of the helical compression spring 11. The forces exerted by the atmospheric air pressure and the spring 11 are in a direction which tends to move the member 8 against its valve seat. The rigidity of the spring 11 is low and in general is such that the degree of compression of the spring can be adjusted by the set screw 10. The force of the helical spring 11 determines the fuel pressure which prevails downstream of the fuel metering and distribution assembly. This pressure acts on the diaphragm 9 in a direction which tends to move the member 8 away from its valve seat.

The pressure regulator 3 is provided in order to compensate for the atmospheric pressure acting on the side of the diaphragm remote from the valve seat. It includes a control member 14 which is guided by a diaphragm 15 whose one side is subjected to fuel pressure and whose other side is subjected to the force of a spring and to the force of atmospheric air pressure.

Atmospheric air pressure is communicated to the other side of the diaphragm 15 by the provision of an opening 19 in the housing 3' of the regulator 3.

In an advantageous manner, the injection valves 1 are embodied as flat-seat valves. The valve closing member 8 is provided with a central bore 13, coaxial with the valve aperture bore 12. On the side of the diaphragm 9 loaded by the helical compression spring 11, this central bore 13 communicates with the ambient air so as to create an air stream which favors atomization of fuel and which is caused by the difference between the atmospheric air pressure and the air pressure in the induction tube of the engine.

What is claimed is:

1. A fuel injection system for continuous fuel injection into the induction tube of a mixture compressing, internal combustion engine, comprising:

a. a fuel source;

b. a fuel pump connected to the fuel source;

c. a constant pressure regulator, said regulator being connected to said fuel pump and receiving therefrom a supply of fuel;

d. a fuel metering and distribution valve assembly, including:

i. a housing, provided with a bore and plurality of fuel channels; and ii. a control slide, said control slide being mounted for displacement within said bore and extending through said housing for externally actuated displacement for the purpose of controlling the effective apertures of said plurality of fuel channels, the assembly being connected to said regulator and receiving therefrom a supply of fuel; and e. a plurality of fuel injection valves, each being connected to a respective one of said plurality of fuel channels and each being supplied with fuel by said fuel metering and distribution valve assembly through its respective fuel channel, each of said valves including:

i. a housing;

ii. a valve seat located within said housing;

iii. a valve closing member cooperating with said valve seat;

iv. a diaphragm, fastened within said housing so that a portion thereof is movable in said housing, with said portion being attached to said valve closing member; and v. a spring, located within said housing, whereby said spring exerts its force against said diaphragm in a direction such that said valve closing member tends to obturate said valve seat, whereby the fuel is admitted to the side of said diaphragm facing said valve seat and exerts a pressure which tends to open said valve seat, and the rigidity of said spring is such that the effect of said spring on the pressure drop across the respective fuel channel aperture is negligible.

2. A fuel injection system as defined in claim 1, wherein said plurality of fuel injection valves are embodied as flat-seat valves.

3. A fuel injection system as defined in claim 1, wherein the fuel valve housing includes means for admitting ambient air pressure to act on said diaphragm in a direction such that said valve closing member tends to obturate said valve seat.

4. A fuel injection system as defined in claim 3, wherein said valve closing member is provided with a central bore permitting the flow of ambient air through said valve closing member.

5. A fuel injection system as defined in claim 4 wherein said plurality of fuel injection valves are embodied as flat-seat valves.

* * * * *